US008113396B2

(12) United States Patent
Schilly

(10) Patent No.: US 8,113,396 B2
(45) Date of Patent: Feb. 14, 2012

(54) CHAIR AND PACK FRAME COMBINATION

(76) Inventor: Robert Schilly, St. Mary, MO (US)

( * ) Notice: Subject to any disclaimer, the term of this patent is extended or adjusted under 35 U.S.C. 154(b) by 578 days.

(21) Appl. No.: 12/327,581

(22) Filed: Dec. 3, 2008

(65) Prior Publication Data

US 2010/0133303 A1 Jun. 3, 2010

(51) Int. Cl.
*A45F 4/02* (2006.01)

(52) U.S. Cl. ..... 224/155

(58) Field of Classification Search ..... 297/55, 297/4, 129; 224/155
See application file for complete search history.

(56) References Cited

U.S. PATENT DOCUMENTS

| | | | | |
|---|---|---|---|---|
| 3,690,525 | A * | 9/1972 | Eugene et al. | 224/155 |
| 3,759,482 | A * | 9/1973 | Wright | 248/449 |
| 3,895,839 | A * | 7/1975 | Amato | 297/4 |
| 3,907,360 | A * | 9/1975 | Czarnowski | 297/156 |
| 3,909,061 | A * | 9/1975 | Johnson | 297/17 |
| 4,057,215 | A * | 11/1977 | Stettler | 248/460 |
| 4,123,127 | A * | 10/1978 | Ford | 312/230 |
| 4,415,149 | A * | 11/1983 | Rees | 269/88 |
| 4,582,165 | A * | 4/1986 | Latini | 182/20 |
| 4,720,029 | A | 1/1988 | Varanakis | |
| 4,836,938 | A | 6/1989 | Kobasic | |
| 4,955,517 | A * | 9/1990 | Maresca | 224/155 |
| 5,016,792 | A * | 5/1991 | Jay | 224/155 |
| 5,289,958 | A * | 3/1994 | Jay | 224/155 |
| 5,297,708 | A * | 3/1994 | Carpenter | 224/155 |
| 5,332,283 | A * | 7/1994 | Gray | 297/58 |
| 5,409,291 | A | 4/1995 | Lamb et al. | |
| 5,494,333 | A | 2/1996 | Wilson | |
| 5,522,642 | A | 6/1996 | Herzog | |
| 5,588,696 | A * | 12/1996 | Jay et al. | 297/129 |
| 5,607,089 | A | 3/1997 | Strum | |
| 5,628,437 | A * | 5/1997 | Kober | 224/155 |
| 5,954,391 | A * | 9/1999 | Gray | 297/58 |
| 6,015,190 | A | 1/2000 | Wend | |
| 6,062,638 | A * | 5/2000 | Ferguson | 297/4 |
| 6,135,557 | A | 10/2000 | Gustafsson | |
| 6,186,593 | B1 * | 2/2001 | Garneau | 297/188.01 |
| 7,052,080 | B2 * | 5/2006 | Knight et al. | 297/4 |
| 7,644,981 | B2 * | 1/2010 | Hensley | 297/17 |
| 7,775,587 | B1 * | 8/2010 | Reed | 297/35 |

FOREIGN PATENT DOCUMENTS

| | | | |
|---|---|---|---|
| GB | 2202431 | A * | 9/1988 |
| GB | 2266231 | A * | 10/1993 |

* cited by examiner

*Primary Examiner* — Brian D Nash
(74) *Attorney, Agent, or Firm* — Shook Hardy & Bacon LLP

(57) ABSTRACT

There is now provided a chair and pack frame combination including telescoping legs, which are pivotably coupled to one another. Front legs are rotatably coupled to a seat frame, the seat frame being adjustable between an up and a down position. The frame also includes a cushion and carrying straps.

9 Claims, 3 Drawing Sheets

CHAIR AND PACK FRAME COMBINATION

BACKGROUND

When engaging in various activities, such as hunting, camping, hiking, attending sporting events, and picnicking, it is common to employ a folding chair or other form of collapsible seating. Often these types of activities take place outdoors on uneven terrain, such that a chair must be adaptable for a user to sit comfortably in a stable position. Moreover, many participants of these activities also utilize a pack or other type of bag, which is more easily transported with a frame securable on a user's back.

SUMMARY

Embodiments of the invention are defined by the claims below, not this summary. A high-level overview of various aspects of the invention are provided here for that reason, to provide an overview of the disclosure, and to introduce a selection of concepts that are further described in the detailed-description section below. This summary is not intended to identify key features or essential features of the claimed subject matter, nor is it intended to be used as an aid in isolation to determine the scope of the claimed subject matter.

There is now provided in an exemplary aspect of the present invention, a chair and pack frame combination, which is variable between a sitting configuration and a carrying configuration. In one embodiment, the combination includes telescoping front legs, which are connected together at a top end. The front legs are rotatably coupled near the top end to telescoping back legs, such that the back legs are spreadable from the front legs to form a sitting configuration. For example, when the back legs are spread away from the front legs, a pod-like structure is formed to stably support a load. In another aspect the back legs are pivoted towards the front legs, thereby collapsing the legs to form a carrying configuration. The front legs are also rotatably coupled near a mid-section to a seat frame, the seat frame being adjustable between an up and a down position. When the seat frame is in a down position and the legs are spread, the front legs might also function as a backrest frame. In an alternative configuration, when the legs are collapsed for carrying, the seat frame might function to support a load.

The frame also includes a cushion, which is positionable in different configurations. For example, in a sitting configuration, the cushion might be positioned against the seat frame and backrest frame. Alternatively, in a carrying position, the cushion is positionable between a user and the combination. Moreover, the frame includes carrying straps.

BRIEF DESCRIPTION OF THE SEVERAL VIEWS OF THE DRAWINGS

Illustrative embodiments of the present invention are described in detail below with reference to the attached drawing figures, wherein.

DETAILED DESCRIPTION

Figure 4:
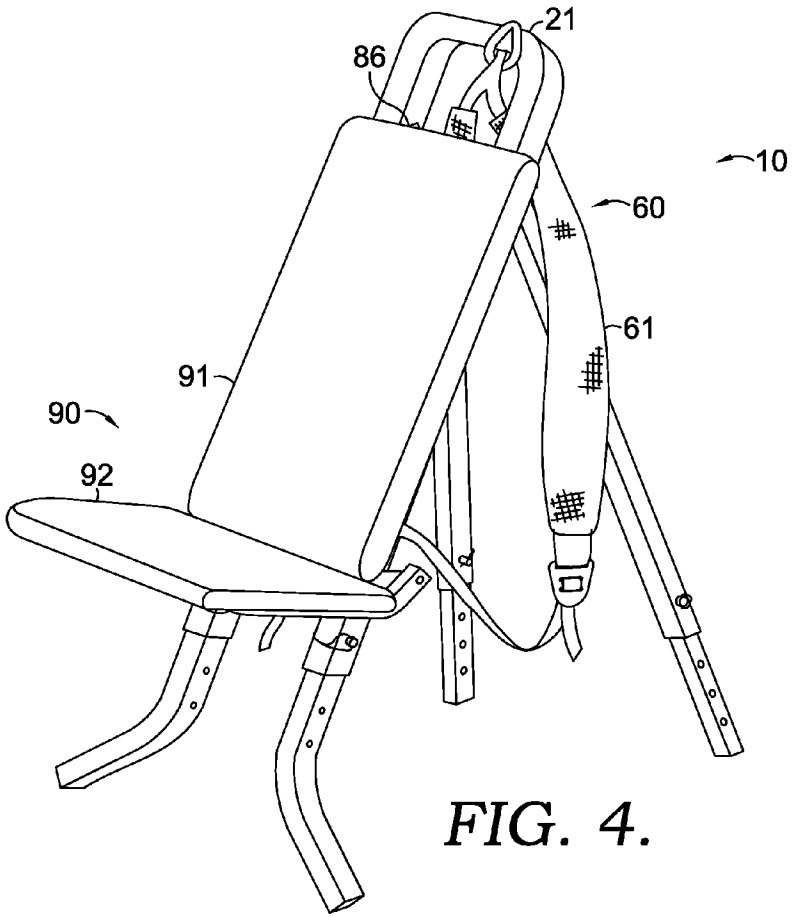
FIG. 4 depicts a perspective view of one embodiment of the present invention.

The present invention will now be described in more detail with reference to the various drawings, wherein a chair and pack frame combination is referenced generally by the numeral 10. A general description of one embedment is first provided, where the combination 10 includes front legs 25*a* and 25*b*, which are connected at a top end by a top cross member 21, thereby forming a u-shaped frame. The front legs 25 are rotatably coupled near the top end to telescoping back legs 50*a* and 50*b*. In a further aspect, a seat frame 40 is rotatably coupled to the front legs 25*a* and 25*b*. The combination 10 might also include a cushion 90, as shown in FIG. 4, which is positionble atop the seat frame in a seated arrangement and positionable between a user and the frame in a carrying arrangement. In a further aspect, the combination 10 includes carrying straps 60, also shown in FIG. 4.

Figure 2:
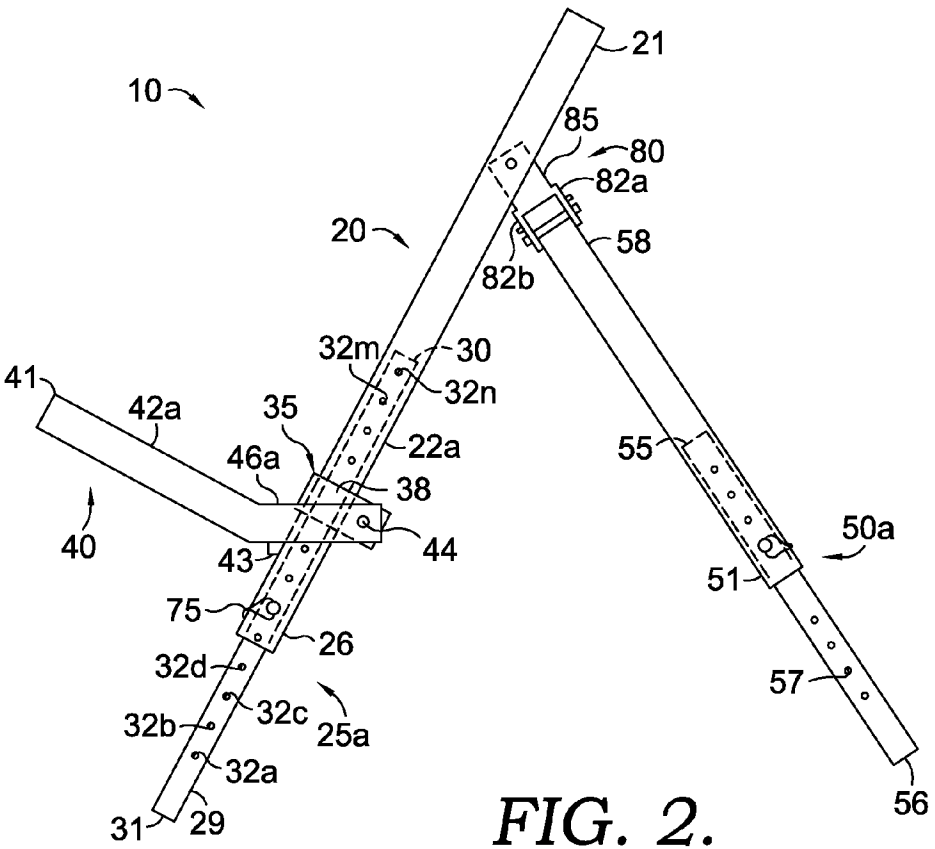
FIG. 2 depicts a side view of one embodiment of the present invention.
Figure 1:
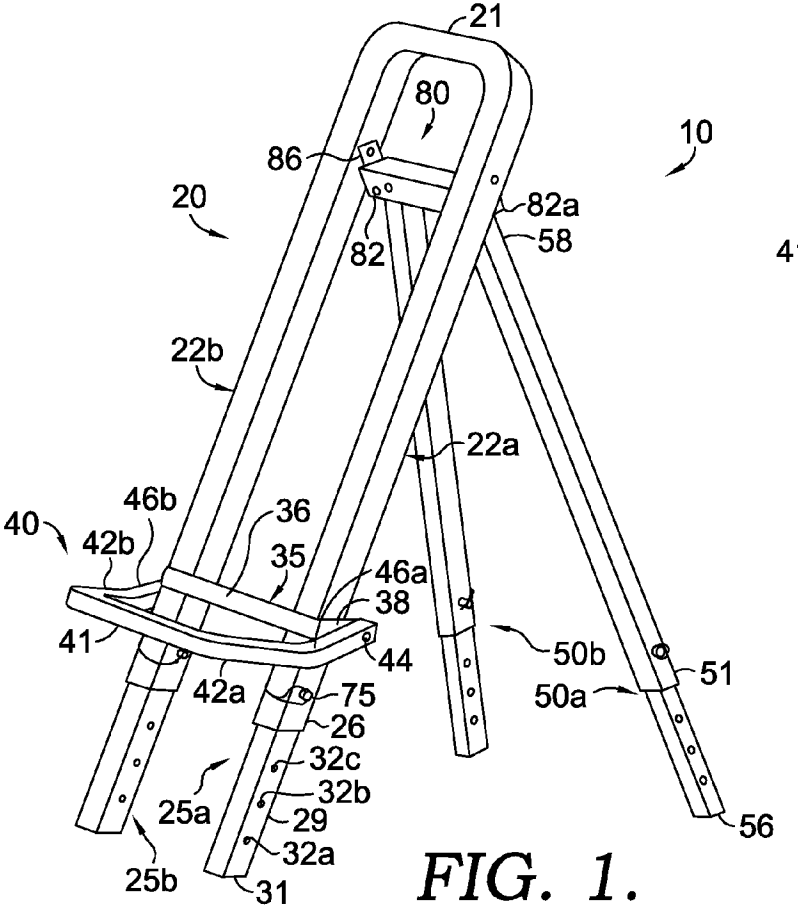
FIG. 1 depicts a perspective view of one embodiment of the present invention.

Referring to FIGS. 1 and 2, in one embodiment, the present invention includes a set of telescoping legs. For example, the invention might include two front telescoping legs 25*a* and 25*b* and two back telescoping legs 50*a* and 50*b*. Telescoping legs generally include components for selectively setting a length. For example, a telescoping leg 25*a* might include a bottom tube 29, which includes a bottom end 31 for resting on a ground surface and an insertion end 30, shown in FIG. 2. (While the following description of a telescoping leg references front leg 25*a*, the same description might apply to one or more of front leg 25*b* and back legs 50*a* and 50*b*.) The bottom end 31 might be capped, such as with a rubber plug, plastic plug or cover. Alternatively, the bottom end 31 might be hollow to facilitate insertion of the combination into a ground surface, e.g., mud, thereby helping to stabilize the frame in place. The bottom end 31 of bottom tube 29 serves as a bottom end for front chair leg 25*a*. In embodiments of the invention, bottom tube 29 includes holes 32*a*, 32*b*, 32*c*, 32*d* . . . 32*m* and 32*n*. Each hole 32*a*, 32*b*, 32*c*, 32*d* . . . 32*m* and 32*n* corresponds with an opposing hole (not shown) on the opposite side of bottom tube 29, such that a pin (or other elongated member) can be passed through and secured within both corresponding holes at the same time. For example, if bottom tube 29 is substantially square, hole 32*c* would correspond to a hole directly across from hole 32*c* on the opposing side of bottom tube 29. The bottom tube 29 might include various shapes or angles. For example, FIG. 1 shows bottom tube 29 as being substantially straight. In an alternative embodiment, as shown in FIG. 4, bottom tube 29 has a bent configuration.

Insertion end 30 (FIG. 2) of bottom tube 29 is for communication with a top tube 26. For example, insertion end 30 might be inserted into an open end of top tube 26, such that a portion of bottom tube 29 is arranged inside top tube 26. In one aspect, both bottom tube 29 and top tube 26 have a substantially similar cross-sectional shape to facilitate easier communication. For example, both tubes might be substantially square or rectangular. Top tube 26 also includes a set of two opposing apertures (not shown) arranged such that a pin 75 can be passed through and secured within both opposing apertures at the same time. In one embodiment, pin 75 is a wire lock pin. In aspects of the invention, holes 32*a*, 32*b*, 32*c*, 32*d* . . . 32*m* and 32*n* of bottom tube 29, and apertures of top tube 26 are alignable when bottom tube 29 is inserted into top tube 26. By removing pin 75 and sliding bottom tube 29 unobstructed either further inside or further removed from top tube 26, and then re-inserting pin 75, bottom tube 29 is securable at various lengths with respect to top tube 26. Because the lengths of chair legs 25*a*, 25*b*, 50*a*, and 50*b* are adjustable (as described with reference to bottom tube 29), combination 10 can be stably positioned on both even and uneven terrain. Furthermore, by adjusting bottom tubes of chair legs 25*a*, 25*b*, 50*a*, and 50*b*, a height of seat frame 40 (further described below) can be raised or lowered.

In further aspects of the invention, top tube 26 extends away from the bottom end 31 and towards a top end of the front chair leg 25*a*. Accordingly, embodiments include a middle portion 22*a* of front chair leg 25*a*, the middle portion 22*a* being between the bottom end 31 and top end of front chair leg 25*a*. As shown in FIG. 1, both front chair legs 25*a* and 25*b* include a middle potion 22*a* and 22*b*, which extend towards the top end in a near parallel arrangement. The middle portions 22*a* and 22*b* terminate at a top cross member 21, which joins the two middle portions 22*a* and 22*b*. In one aspect of the invention, both middle portions 22*a* and 22*b* and the top cross member 21 include a bent tube made of a rigid material, such as steel. As will be further described below, middle portions 22*a* and 22*b* might also serve as a backrest frame for the combination 10, such as when seat frame 40 is in a down position.

In other aspects of the invention, coupled to both middle portions 22*a* and 22*b* is a mounting plate 35, which serves as a base onto which seat frame 40 might be rotatably coupled. In an embodiment, mounting plate 35 comprises a flat elongated member 36, which terminates at bent ends. For example, mounting plate 35 includes a bent left end 38 and a bent right end (not shown). In one aspect, the bent left end 38 and bent right end serve to at least partially fit around outer edges of the front legs 25*a* and 25*b*. In one arrangement, bent left end 38 and bent right end fit around middle portions 22*a* and 22*b*. The mounting plate 35 might be coupled to the front legs 25*a* and 25*b* in a variety of ways, such as by welding the mounting plate 35 to the front legs 25*a* and 25*b*. Alternatively, mounting plate 35 might be coupled to the front legs with fasteners.

Mounting plate 35 serves as a base to pivotally couple seat frame 40 to the middle portions 22*a* and 22*b*. For example, in one aspect seat frame 40 includes a cross bar 41, which terminates in a left arm 42*a* and right arm 42*b* extending from the respective sides of the cross bar 41. Seat frame 40 might include a single tube which is bent to create cross bar 41, left arm 42*a*, and right arm 42*b*. To pivotally couple seat frame 40, in one arrangement the left arm 42*a* receives a fastener 44, which also engages bent left end 38 of mounting plate 35. Likewise, right arm 42*b* receives a fastener (not shown), which also engages bent right end of mounting plate 35. In one aspect the fasters are bolts, which serves as an axis on which the left arm 42*a* and right arm 42*b* rotate relative to mounting plate 35. In aspects of the invention, left arm 42*a* and right arm 42*b* include a bend 46*a* and 46*b* respectively. Bends 46*a* and 46*b*, in combination with other elements of the frame 10, enable seat frame 40 to extend from front legs 25*a* and 25*b* in a plane that positions a user that is sitting on seat frame 40 in a recline position. In a further embodiment, the combination 10 includes a stop bar 43 (shown in FIG. 3) for the seat frame's range of motion downward. Stop bar 43 is coupled to an underneath side of seat frame 40, such that when seat frame 40 is rotated downward, stop bar 43 abuts front legs 25*a* and 25*b* to prevent further rotation. In one arrangement, stop bar 43 abuts middle portions 22*a* and 22*b* of the front legs. As will be further described below, the stop bar 43 might also serve as a location on the combination 10 for tying down carrying straps 60.

Figure 5:
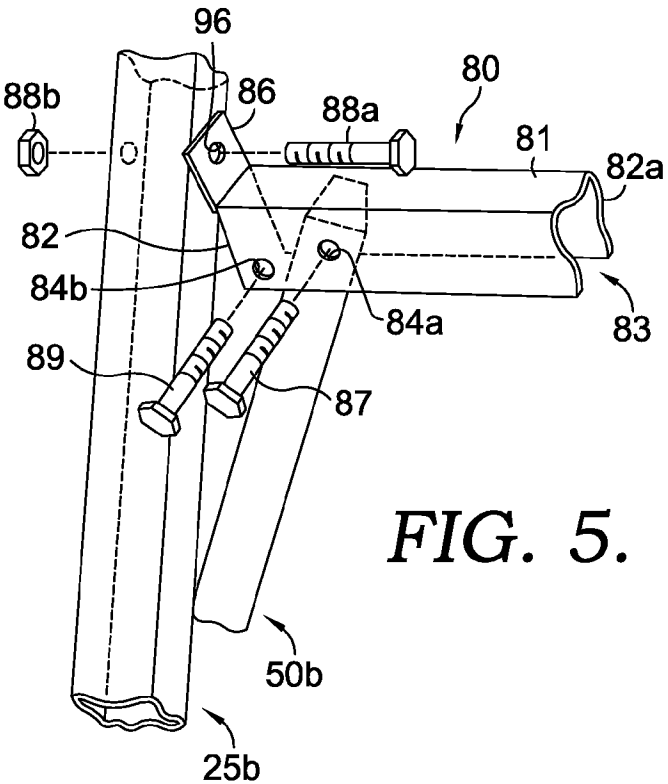
FIG. 5 depicts a perspective and partially exploded view of one embodiment of the present invention.

In a further embodiment of combination 10, each back leg 50*a* and 50*b* is pivotally coupled to the front legs 25*a* and 25*b* by a channel mounting component 80. Referring to FIGS. 2 and 5, channel mounting component 80 includes a left tab 85 and a right tab 86 for pivotably mounting the channel mounting component 80 to front legs 25*a* and 25*b*. For example, tabs 85 and 86 might each include a hole that aligns with corresponding holes in front legs 25*a* and 25*b*. In one arrangement, holes in front legs 25*a* and 25*b* are positioned along middle portions 22*a* and 22*b* near the top end of the front legs. As shown in FIG. 5, hole 96 of tab 86 is alignable with holes in front leg 25*b*, such that a fastener 88a and 88b can engage both tab 86 and front leg 25*b*. Extending between and connecting tab 85 and tab 86 is a channel portion of the channel mounting component 80, including a top plate 81, back plate 82*a*, and front plate 82*b*, which from a channel 83.

Figure 6:
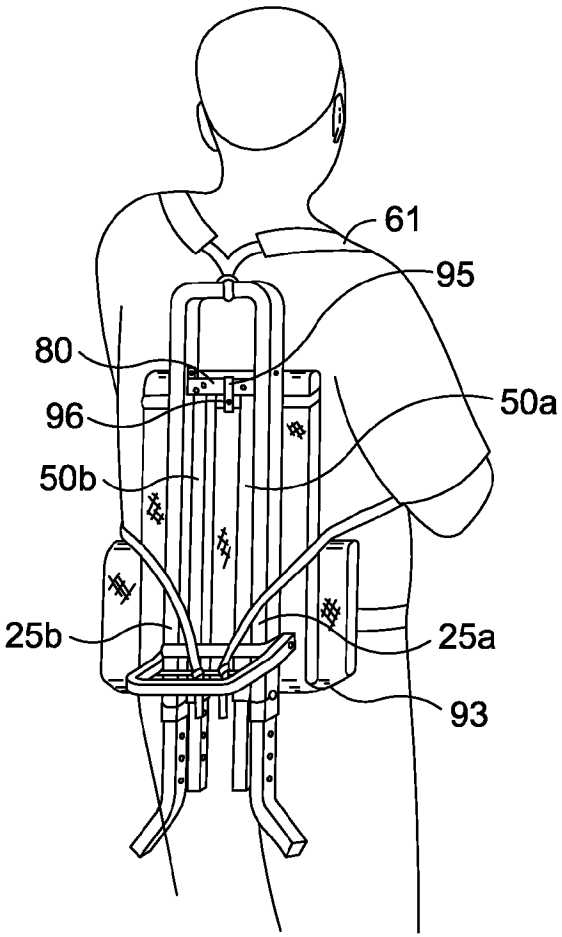
FIG. 6 depicts a perspective view of one embodiment of the present invention.

In an aspect of the invention, channel mounting component 80 is rotatable around fasteners that connect tabs 85 and 86 to front legs 25*a* and 25*b*. For example, fastener 88*a* and 88*b*, in addition to a similar fastener (not shown) for tab 85, might serve as an axis around which channel mounting component 80 rotates. A rotatable configuration enables channel mounting component 80 (and back legs 50*a* and 50*b* coupled thereto) to be positionable in a same or similar plane as front legs 25*a* and 25*b*. FIG. 6 depicts an illustrative embodiment in which channel mounting component 80, in combination with back legs 50*a* and 50*b*, is positioned in a substantially same plane as front legs 25*a* and 25*b*. Collapsing legs 25*a*, 25*b*, 50*a*, and 50*b* in such a manner forms part of a carrying configuration.

In other aspects, channel mounting component 80 is rotatable, such that channel mounting component (and back legs 50*a* and 50*b* coupled thereto) is positionable in a plane outside the plane of front legs 25*a* and 25*b*, i.e., the bottom ends of the legs are spread apart. For example, FIGS. 1 and 2 depict an illustrative embodiment in which channel mounting component 80, in combination with back legs 50*a* and 50*b*, is rotated outside of a plane of front legs 25*a* and 25*b*. Rotating the channel mounting bracket 80 outside the plane of front legs 25*a* and 25*b* creates a reclined sitting configuration for the combination. For example, FIG. 2 shows that the backrest portion 20, is in a reclined configuration. The further the channel mounting bracket 80 (and back legs 50*a* and 50*b* coupled thereto) is rotated outside the plane of front legs 25*a* and 25*b*, the greater the recline of backrest 20.

As previously described, in an illustrative embodiment, back legs 50*a* and 50*b* are coupled to channel mounting bracket 80. In aspects of the invention, top ends of each back leg 50*a* and 50*b* attach in channel 83. For example, back plate 82*a* includes holes (not shown) that correspond with and are aligned with holes 84*a* and 84*b* (shown in FIG. 5). Moreover, back leg 50*b* includes corresponding holes (not shown) in a top portion that are alignable with hole 84*a* and its corresponding hole in back plate 82*a*, such that a fastener 87 can be secured through both the channel mounting component 80 and back leg 50*b*. Accordingly, fastener 87 both couples back leg 50*b* to the channel mounting bracket 80 (and indirectly to front leg 25*b* ) and serves as an axis on which back leg 50*b* can pivot within the plane of channel 83. In aspects of the invention, back leg 50*a* is pivotally coupled to channel mounting bracket 80 in a similar fashion to back leg 50*b*. Accordingly, both back legs 50*a* and 50*b* are pivotable within the plane of channel 83, such that the bottom ends of back legs 50*a* and 50*b* can be spread apart from each other or collapsed towards one another. In a further embodiment, the combination 10 includes stop pins for preventing back legs 50*a* and 50*b* from pivoting beyond a certain point. For example, stop pin 89

(shown in FIG. 5) prevents back leg 50*b* from pivoting beyond a certain point. A similar stop pin is provided for back leg 50*a*. As previously indicated, although FIG. 5 only shows back leg 50*b*, in aspects of the invention back leg 50*a* is pivotally coupled in a similar fashion.

In aspects of the invention, the combination 10 is capable of various configurations. For example, in seating configurations shown in FIGS. 1, 2, and 4, the back legs 50*a* and 50*b* are both spread away from front legs 25*a* and 25*b* and are spread away from each other, thereby creating a stable frame upon which a user might sit when seat frame 40 is in a down position. In a seating configuration, front legs 25*a* and 25*b* and back legs 50*a* and 50*b* might be independently telescopically lengthened or shortened to adjust to terrain that is uneven and/or slanted. The present combination 10 also includes a carrying configuration. In a carrying configuration, shown in FIG. 6, the back legs 50*a* and 50*b* are pivoted towards one another and are rotated close to front legs 25*a* and 25*b*, such that back legs 50*a* and 50*b* are positionable between front leg 25*a* and 25*b*. Seat frame 40 might be positioned downward so as to support a load.

In a further embodiment, the present invention comprises a releasably attachable cushion 90. In an illustrative embodiment shown in FIG. 4, the releasably attachable cushion 90 comprises both a back cushion 91 and seat cushion 92. In one embodiment the back cushion 91 and seat cushion 92 are hingedly attached, such as by a seam 93. In addition, the releasably attachable cushion 90 comprises a fastener for releasably attaching the cushion 90 to a portion of the combination 10. In one embodiment, as shown in FIG. 6, the fastener for releasably attaching the cushion 90 to a frame of the invention attaches to channel mounting component 80. In one aspect, the fastener for releasably attaching the cushion 90 comprises one or more flexible extensions 95 securely attached at one end to the cushion 90 and a releasable mechanism 96 attached to the flexible extension 95. In one embodiment the flexible extension 95 is sewn at one end to the cushion. In a further embodiment, the releasable mechanism 96 includes hook and loop strips, snaps, clips, or similar mechanism. The releasably attachable cushion 90 might be designed to have a shape or coloration that is specific to the intended use of the combination 10. For example, cushion 90 might include camouflage, sport themes, team insignia, etc. The cushion 90 is positionable in various configurations depending on the configuration of the frame. As exemplified in FIG. 4, the cushion is positionable over the seat frame and front legs to serve as a sitting surface. In another aspect, as exemplified in FIG. 6, the cushion 90 is positionable between a user and the frame. In an alternative embodiment, one or more cushions are integrally constructed with portions of the frame.

Figure 3:
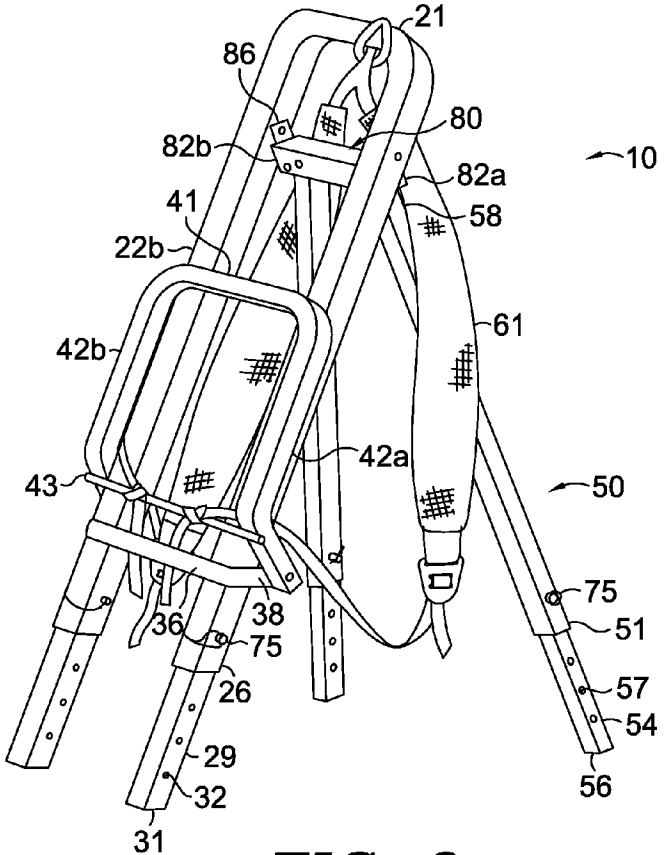
FIG. 3 depicts a perspective view of one embodiment of the present invention.

In a further embodiment, the present invention includes one or more carrying straps 60. In one embodiment, the carrying straps 60 releasably attach to a frame portion of the combination 10. For example, the carrying straps 60 might tie or otherwise attach at one terminating end to top cross member 21. In one embodiment, as shown in FIGS. 3, 4 and 6, two carrying straps 60 extend from a terminating end, which attaches to top cross member 21, such that the carrying straps 60 can be worn similar to a back pack. Carrying straps 60 might include padding 61. Padding 61, or other portions of the carrying straps might also include design or coloration specific to an intended use of the combination. In another aspect, the carrying straps 60 attach at an opposing terminal end onto the stop bar 43 or to the mounting plate 35. In some aspects, carrying straps 60 may releasably attach to frame portions of the combination, such as by snaps, hook and loop strips, or similar devices.

Based on the foregoing description, the combination 10 might include various configurations. In one aspect, a chair and pack frame combination 10 includes a set of front telescoping legs 25*a* and 25*b*, each including a stabilizing end 26 for communicating with a ground surface and an opposing top end. A seat frame 40 is rotatably coupled to the front telescoping legs. Also, a set of back telescoping legs 50*a* and 50*b* are rotatably coupled near the top end of the front telescoping legs. The combination also includes at least one carrying strap 60, and a releasably attachable cushion 90.

In another configuration, the combination 10 includes a set of front telescoping legs 25*a* and 25*b*, each including a stabilizing end 26 for communicating with a ground surface and an opposing top end. Each front telescoping leg extends from its respective stabilizing end near parallel to the other front telescoping leg in the plurality. Also, a mounting bracket 35 is coupled to the plurality of front telescoping legs and a seat frame 40 is rotatably coupled to the mounting bracket 35. When the seat frame is in a downward orientation it forms a load bearing surface, and when the frame is used as a seat, portions of the front legs form a backrest 20. One or more back telescoping legs 50*a* and 50*b* are rotatably coupled near the top ends of the plurality of front telescoping legs, wherein the one or more back telescoping legs each terminate at an opposing stabilizing end 56 and wherein rotation of the stabilizing end of away from the plurality of front telescoping legs reclines the backrest. In addition, a configuration might include at least one carrying strap 60 and a releasably attachable cushion 90.

In another aspect the present invention includes a chair and pack frame combination 10 variable between a sitting configuration and a carrying configuration. For example, the combination might comprise two front telescoping legs 25*a* and 25*b*, each front telescoping leg comprising: a stabilizing end 26 for communication with a ground surface; a top end opposing the stabilizing end; and a middle portion 22*a* and 22*b* extending between the stabilizing end and the top end. Moreover, a seat frame 40 might be rotatably coupled to the middle portion of each front telescoping leg 25*a* and 25*b*, wherein the seat frame 40, when in a downward orientation, forms load bearing support, such that in the sitting configuration the middle portion 22*a* and 22*b* of each front telescoping leg forms a backrest 20. Furthermore, a channel mounting component 80 might be rotatably coupled near the top end of each front telescoping leg, the channel mounting component comprising: a left tab 85 for pivotable attachment to a left front telescoping leg 25*a* and a right tab 86 for pivotable attachment to a right front telescoping leg 25*b* ; and a channel 83 extending between and connecting the left tab and the right tab. In an exemplary aspect, two back telescoping legs 50*a* and 50*b* are pivotally attached at a top end in the channel. Each back telescoping leg terminates at a stabilizing end 56 for communicating with a ground surface, wherein in the sitting configuration rotation of the stabilizing end away from the front telescoping legs reclines the backrest when all stabilizing ends are communicating with the ground surface. Also included are at least one carrying strap 60 and a cushion 90. The cushion 90 is positionable over the seat frame 40 and backrest 20 when the combination is in a sitting configuration and is positionable between a user and the combination in a carrying configuration.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

The invention claimed is:

1. A chair and pack frame combination comprising:

one or more front telescoping legs comprising a stabilizing end for communicating with a ground surface and an opposing top end;

a mounting plate coupled to the one or more front telescoping legs;

a seat frame rotatably coupled to the mounting plate;

one or more back telescoping legs rotatably coupled near the top end of the one or more front telescoping legs;

one or more carrying straps coupled near the top end; and a releasably attachable cushion for positioning against the seat frame.

2. The combination of claim 1 wherein the one or more front telescoping legs comprises two front telescoping legs and wherein the front telescoping legs each extend from a respective stabilizing end near parallel to one another and are joined at the top end of each telescoping leg by a top cross member.

3. The combination of claim 1, wherein the seat frame further comprises a stop bar coupled to the underneath side of the seat frame, the stop bar functioning to limit downward rotation of the seat frame.

4. The combination of claim 1 further comprising a channel mounting component rotatably coupled to the one or more front telescoping legs, the channel mounting component for rotatably attaching the one or more back telescoping legs to the one or more front telescoping legs.

5. The combination of claim 4 wherein:

the combination comprises a left front telescoping leg and a right front telescoping leg, both of which extend from a respective stabilizing end near parallel to each other; and the channel mounting component comprises:

(1) a left tab for pivotable attachment to the left front telescoping leg and a right tab for pivotable attachment to the right front telescoping leg; and (2) a channel extending between and connecting the left tab and the right tab, wherein the one or more back telescoping legs pivotally attach at one end inside the channel.

6. A chair and pack frame combination comprising:

a plurality of front telescoping legs, each front telescoping leg comprising a front leg stabilizing end for communicating with a ground surface and an opposing top end, wherein each front telescoping leg extends from its respective front leg stabilizing end near parallel to the other front telescoping legs in the plurality;

a mounting bracket coupled to the plurality of front telescoping legs;

a seat frame rotatably coupled to the mounting bracket, wherein the seat frame, when in a downward orientation, forms a load bearing surface, such that a portion of the plurality of front telescoping legs form a backrest when the frame is in a sitting configuration;

one or more back telescoping legs rotatably coupled near the top ends of the plurality of front telescoping legs, wherein the one or more back telescoping legs each terminate at an opposing back leg stabilizing end and wherein rotation of the back leg stabilizing end away from the plurality of front telescoping legs reclines the backrest;

one or more carrying straps coupled near the top end; and a releasably attachable cushion, which is positionble against the plurality of front telescoping legs and the seat frame.

7. The combination of claim 6, wherein each telescoping leg comprises a bottom tube having a set of corresponding holes and a top tube having a set of corresponding holes, wherein a cross-section of the bottom tube is either larger or smaller than a cross-section of the top tube, and wherein the bottom tube corresponding holes are alignable with top tube corresponding holes, such that a pin is insertable through all corresponding holes.

8. The combination of claim 6 wherein the mounting bracket terminates in bent ends and wherein arms of the seat frame are rotatably coupled to the bent ends.

9. A chair and pack frame combination variable between a sitting configuration and a carrying configuration, the combination comprising;

two front telescoping legs, each front telescoping leg comprising:

(1) a front leg stabilizing end for communication with a ground surface;

(2) a front leg top end opposing the stabilizing end; and (3) a middle portion extending between the stabilizing end and the top end;

a seat frame rotatably coupled to the middle portion of each front telescoping leg, wherein the seat frame, when in a downward orientation, forms load bearing support, such that in the sitting configuration the middle portion of each front telescoping leg forms a backrest;

a channel mounting component rotatably coupled near the front leg top end of each front telescoping leg, the channel mounting component comprising:

(1) a left tab for pivotable attachment to a left front telescoping leg and a right tab for pivotable attachment to a right front telescoping leg; and (2) a channel extending between and connecting the left tab and the right tab;

two back telescoping legs pivotally attached at a respective back leg top end in the channel, each back telescoping leg terminating at a back leg stabilizing end for communicating with a ground surface, wherein in the sitting configuration rotation of the back leg stabilizing end of each back telescoping leg away from the front telescoping legs reclines the backrest when all stabilizing ends are communicating with the ground surface;

one or more carrying straps coupled near at least one of the front leg top end of each front leg and the channel mounting component; and a cushion for positioning over the seat frame and backrest when the combination is in a sitting configuration and for positioning between a user and the combination in a carrying configuration.

* * * * *